US009586742B2

(12) United States Patent
Zacherle et al.

(10) Patent No.: US 9,586,742 B2
(45) Date of Patent: Mar. 7, 2017

(54) BLISTER PACKAGE WITH DIVIDED INTERIOR VOLUME

(71) Applicant: WestRock MWV, LLC, Norcross, GA (US)

(72) Inventors: Matthew E. Zacherle, Chesterfield, VA (US); Gregory P. Hayter, Richmond, VA (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

(21) Appl. No.: 14/880,837

(22) Filed: Oct. 12, 2015

(65) Prior Publication Data

US 2016/0101919 A1 Apr. 14, 2016

Related U.S. Application Data

(60) Provisional application No. 62/063,097, filed on Oct. 13, 2014.

(51) Int. Cl.

| | |
|---|---|
| ***B65D 75/36*** | (2006.01) |
| ***B65B 5/02*** | (2006.01) |
| ***B65B 61/00*** | (2006.01) |
| ***B65D 73/00*** | (2006.01) |

(52) U.S. Cl.

CPC ..... *B65D 75/36* (2013.01); *B65B 5/024* (2013.01); *B65B 61/005* (2013.01); *B65D 73/0092* (2013.01)

(58) Field of Classification Search

CPC ..... B31D 51/0004; B65B 5/02; B65B 5/024; B65B 7/26; B65B 51/10; B65B 61/00; B65B 61/005; B65D 73/00; B65D 73/0042; B65D 73/0092; B65D 75/32; B65D 75/36; B65D 75/366; B65D 75/52; B65D 75/522

USPC ..... 206/461, 462, 464–465, 467–471; 53/410; 493/90

See application file for complete search history.

(56) References Cited

U.S. PATENT DOCUMENTS

| | | | |
|---|---|---|---|
| 4,165,805 | A | 8/1979 | Fethke et al. |
| 4,872,551 | A | 10/1989 | Theros |
| 5,279,417 | A | 1/1994 | Seaton |
| 7,389,907 | B2 | 6/2008 | Smith |
| 8,251,214 | B2 | 8/2012 | Wade |
| 2010/0101976 | A1 | 4/2010 | Urban |
| 2010/0193392 | A1 | 8/2010 | Karow |
| 2015/0344207 | A1 | 12/2015 | Zacherle |
| 2016/0194130 | A1 | 7/2016 | Zacherle |

FOREIGN PATENT DOCUMENTS

| | | | | |
|---|---|---|---|---|
| CH | 623539 A5 | * | 6/1981 | ..... B65D 75/36 |
| JP | 11171243 A | * | 6/1999 | ..... B65D 75/36 |

* cited by examiner

*Primary Examiner* — Bryon Gehman

(74) *Attorney, Agent, or Firm* — WestRock Intellectual Property Group

(57) ABSTRACT

A blister card utilizes a window waste portion as a non-planar or multi-level divider within the blister.

12 Claims, 6 Drawing Sheets

FIG. 2
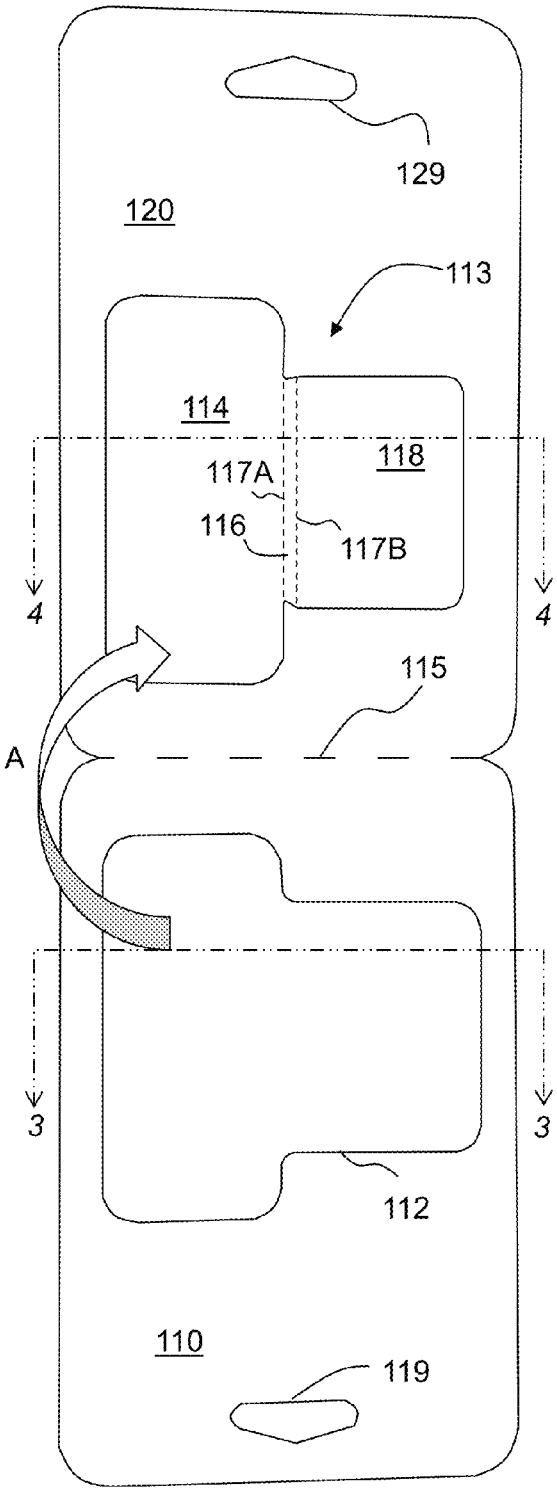
FIG. 3
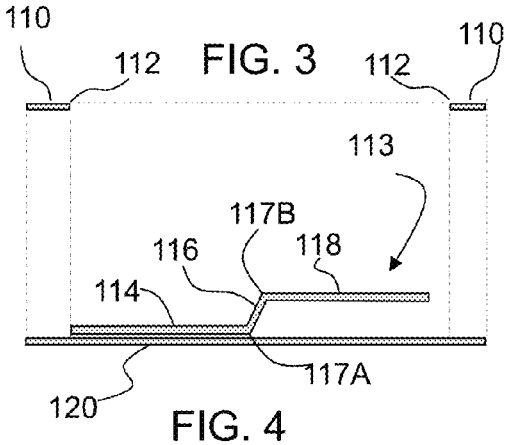
FIG. 4

FIG. 5
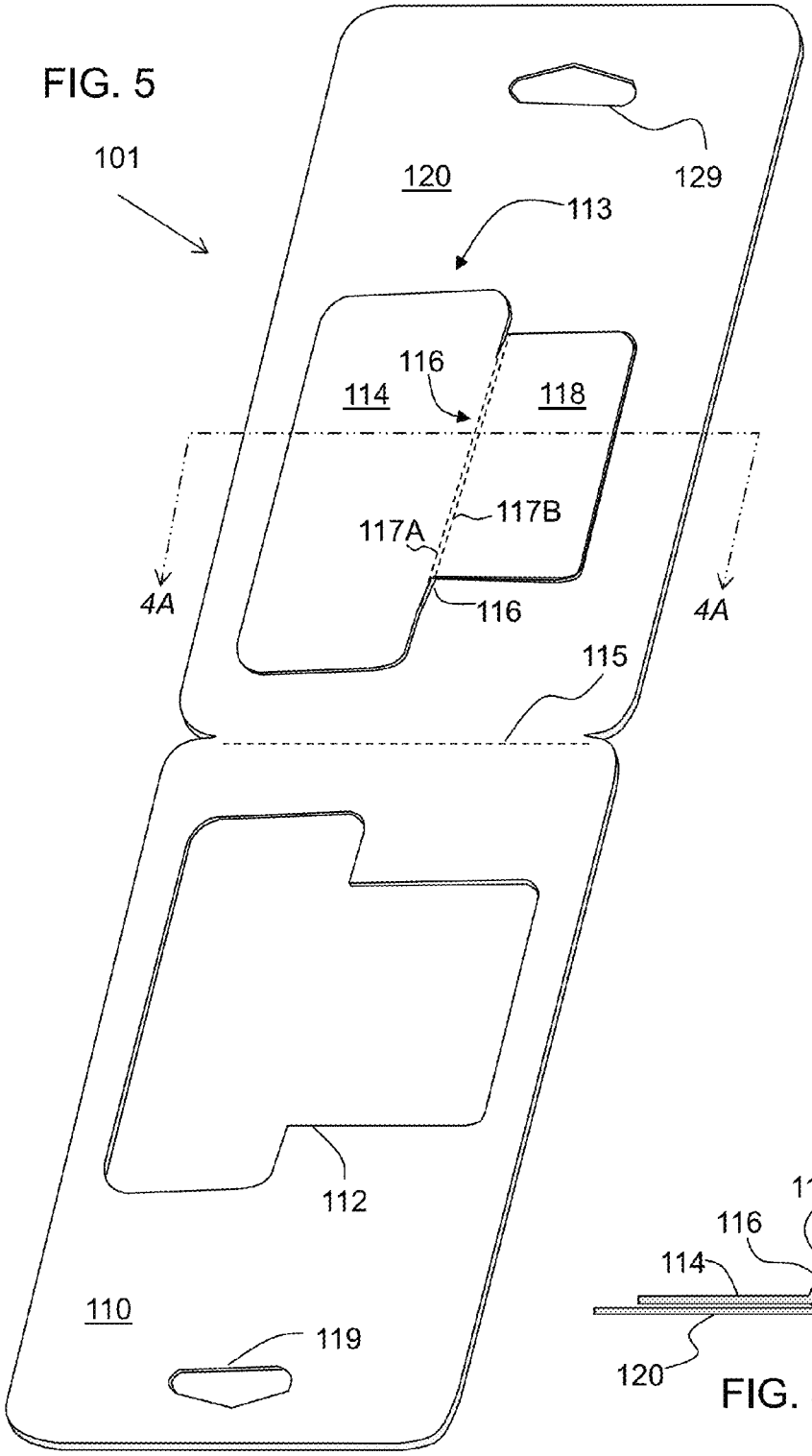
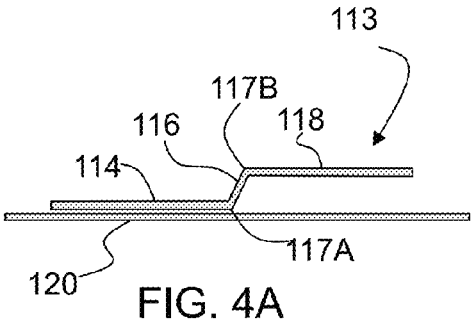
FIG. 4A

BLISTER PACKAGE WITH DIVIDED INTERIOR VOLUME

REFERENCE TO RELATED APPLICATION

This application claims the benefit of priority under 35 U.S.C. §119(e) of U.S. provisional application Ser. No. 62/063,097 filed on Oct. 13, 2014, which is hereby incorporated by reference in its entirety.

BACKGROUND

The present application is directed to blister cards, and more particularly, to two-ply blister cards where the blister extends through a window in one card, and the removed portion of that card becomes a non-planar or multi-level panel within the blister.

Merchandise items are often packaged on blister-type display cards. Such display cards may include a plastic blister to hold the product, and a printed paperboard card describing the product. In a two-ply card, the blister may protrude through one of the cards. When a portion or window of a card is removed to create an opening to receive the blister, the removed portion or "window waste" is sometimes placed flat inside the blister behind a product item to create a background.

The present invention utilizes a "split-level" window waste to create a novel package.

SUMMARY

In one embodiment a blister card is disclosed which includes a front panel with a window therein created by at least partly separating a cutaway portion from the front panel; a back panel attached to the front panel; a blister including a blister cavity and a peripheral flange, the blister cavity protruding through the window and the peripheral flange received between the front and back panels; wherein the cutaway portion is positioned between the blister and the back panel; and the cutaway portion divides the blister cavity into two or more volumes.

In certain embodiments the cutaway portion is in register with the window.

In certain embodiments the cutaway portion includes one or more fold lines.

In certain embodiments the cutaway portion includes a lower portion connected by a first fold line to a riser portion.

In certain embodiments the riser portion is connected by a second fold line to a divider portion.

In certain embodiments the lower portion is in contact with the back panel, the riser portion extends generally away from the back panel, and the divider portion is spaced apart from the back panel.

In certain embodiments the riser portion is at an angle to the back panel, and the divider portion is substantially parallel to the back portion.

In certain embodiments the lower portion is attached to the back card.

In certain embodiments the front panel and back panel are fastened together by adhesive.

In certain embodiments the front panel and back panel are fastened together by heat sealing.

A method of constructing a blister card is also disclosed, the method including providing a front panel with a window therein created by at least partly separating a cutaway portion from the front panel; providing a back panel; folding the cutaway portion into three parts including a lower portion foldably connected to a riser portion, in turn foldably connected to a divider portion; placing the lower portion of the cutaway onto the back panel; providing a blister including a blister cavity and a peripheral flange; positioning the blister upon the back panel with the cutaway received in the blister cavity; placing the front panel upon the blister and back panel so that the blister cavity protrudes through the window and the peripheral flange is received between the front and back panels; and attaching the front panel to the back panel, wherein the cutaway portion divides the blister cavity into two or more volumes.

In certain embodiments, method further includes placing a product item or items within at least one of the volumes.

Other aspects of the disclosed packaging structures and methods will become apparent from the following description and the accompanying drawings.

BRIEF DESCRIPTION OF THE DRAWINGS

The attached Figures show blister cards including a blister sandwiched between a pair of cards.

FIG. 2 shows a plan view of the blank after removing a window area from the front panel, forming a step fold in the window waste, and positioning the window waste in register on the back panel;

FIG. 3 shows a cross section of the top panel as it will (later) be positioned over the window waste and back panel;

FIG. 4 shows a cross section of the back panel and the window waste;

FIG. 5 shows an isometric view of the same structure as FIG. 2;

FIG. 4A repeats the drawing of FIG. 4, for comparison with FIG. 5;

DETAILED DESCRIPTION

Figure 1:
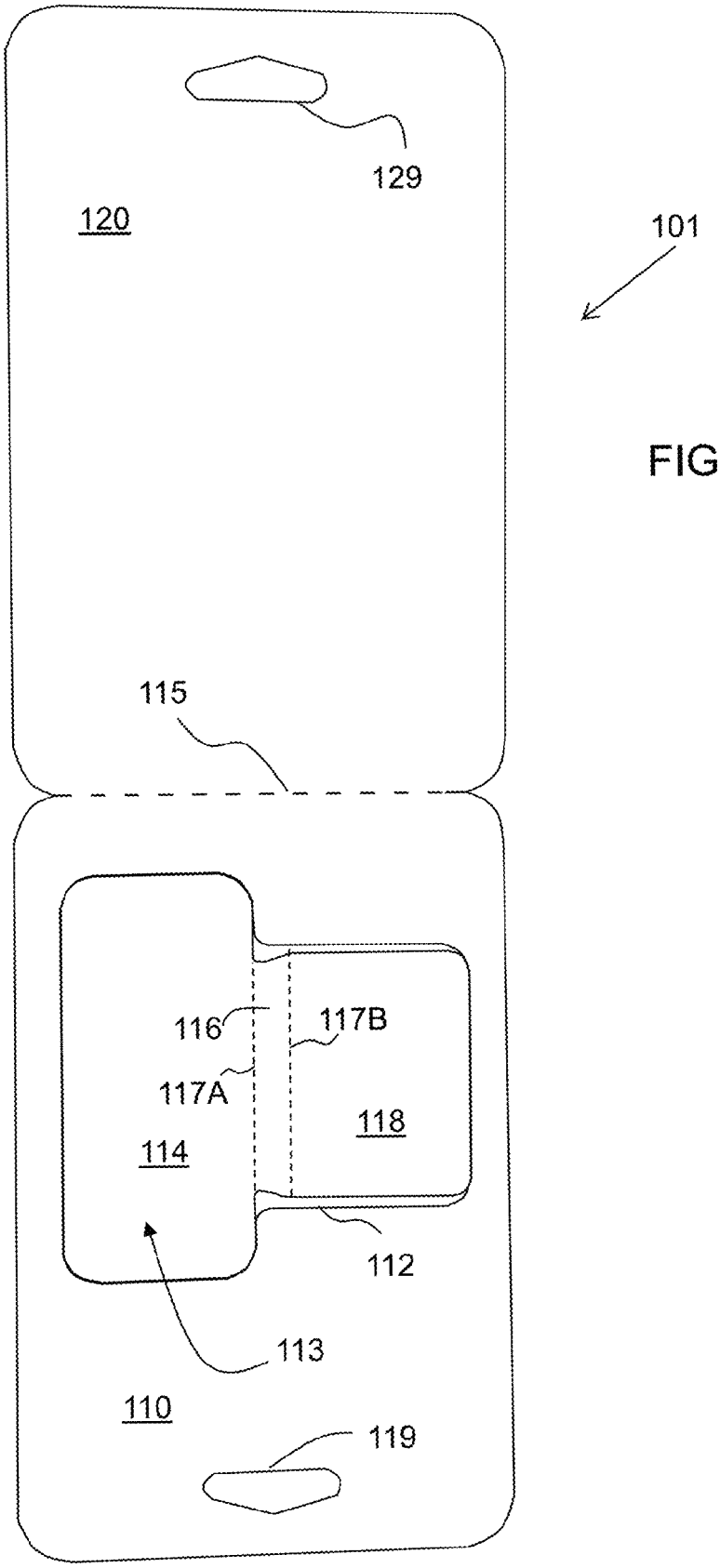
FIG. 1 shows a plan view of a blank for making a front panel and back panel for a blister package.

As various embodiments of the blister card are described, reference will be made to the attached Figures. Certain parts of the blister cards are denoted by reference numerals. Where there is more than one of the same feature, sometimes only one will be denoted by a reference numeral. If different blister cards have a common feature, it may only be described one time.

Where assembly steps are described, these steps are exemplary and are not to be limiting as to the sequence of operations used to arrive at the final blister card. Also, directions such as up, down, top, bottom, front, back, etc. are used for convenience in describing the structure and are not meant to be limiting. In most cases the blister cards described here are made from one or several blanks (that is, the cut sheet parts from which the blister cards are made by folding and other steps). However, it should be understood that certain unitary blanks may be provided instead as more than one part, and certain blanks may be combined into single blanks, while still arriving at the same finished package.

FIG. 1 shows a plan view of a blank 101 for making a blister card 100. The blank may include a front panel 110 with a back panel 120 hingedly attached through a fold line 115 at the common edge of front panel 110 and back panel 120. The front panel 110 and back panel 120 may each include a hang hole 119, 129. An opening or window 112 may be provided in the front panel 110. The window 112 may define a cutaway portion 113 (sometimes called 'window waste') in front panel 110. The cutaway portion 113 may be approximately the shape as the window 112, or it may differ in shape. The cutaway portion 113 may be approximately the same size, or slightly smaller, than the window 112, or it may be substantially smaller than the window 112.

The cutaway portion 113 may include a cutaway lower portion 114, attached through fold line 117A to a riser portion 116, attached in turn through fold line 117B to an upper or divider portion 118.

As shown in FIG. 2, the cutaway portion 113 may be flipped over and transferred (as per arrow A) onto the back panel 120 into a mirrored position that will (after folding the panels along fold line 115) bring the cutaway lower portion 114 back into register with window 112. Cutaway portion 113 may be fastened to back panel 120 by glue, heat sealing, hot-melt adhesive, stapling, or other method, preferably holding only cutaway lower portion 114 ("lower" indicating a placement in the finished package) directly onto back panel 120. As shown in FIG. 4, the riser portion 116 may be folded upward along fold line 117A, at any suitable angle, and the upper or divider portion 118 may then be folded back toward a generally horizontal level (or any suitable angle as chosen by manufacturing preference) along fold line 117B. This creates a space between back panel 120 and divider portion 118, as best seen in FIG. 4.

FIG. 5 shows an isometric view of the same structure as FIG. 2. FIG. 4A repeats the cross section view previously shown in FIG. 4.

Figure 6:
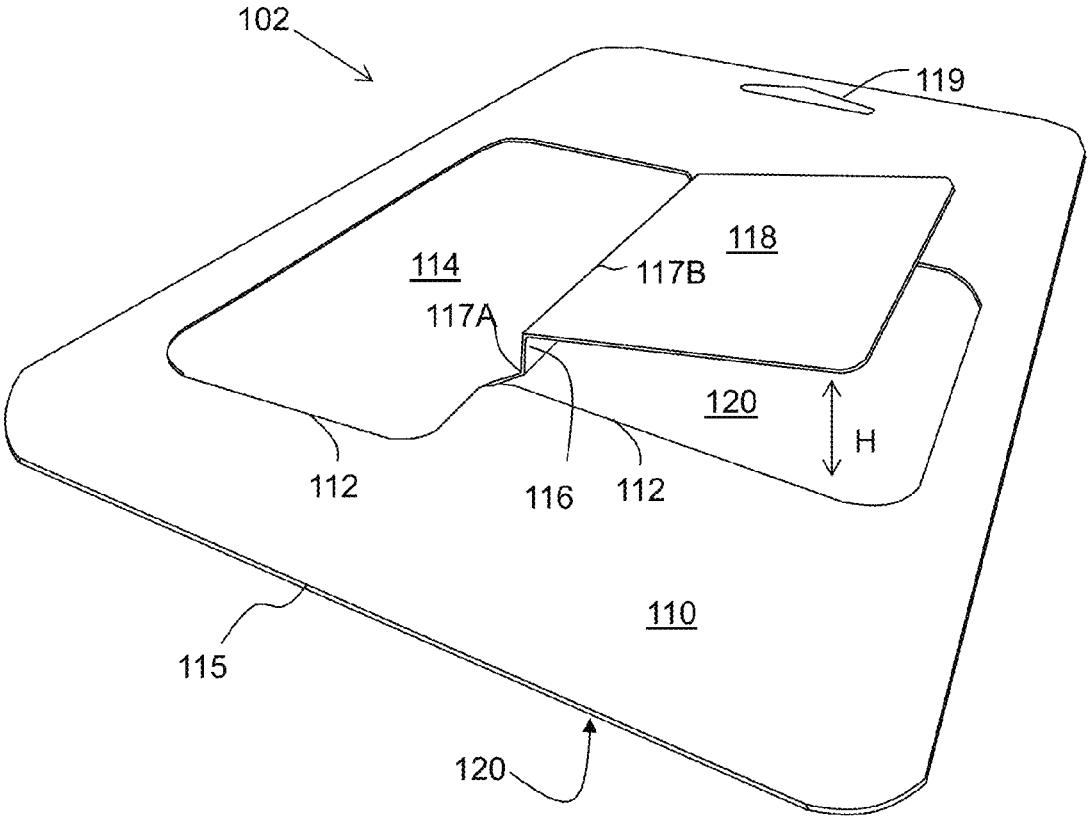
FIG. 6 shows a perspective view of the structure of FIG. 5, after the front panel is folded over onto the back panel and window waste.

FIG. 6 shows a perspective view of a two-ply card structure 102 that would result if the front panel 110 is folded onto the back panel 120. A space of height H now exists between the back panel 120 and the divider portion 118. However, before folding the front panel 110 onto the back panel 120, a blister 130 (with a product or products in the blister) may be placed between the panels as shown in FIG. 7.

Figure 7:
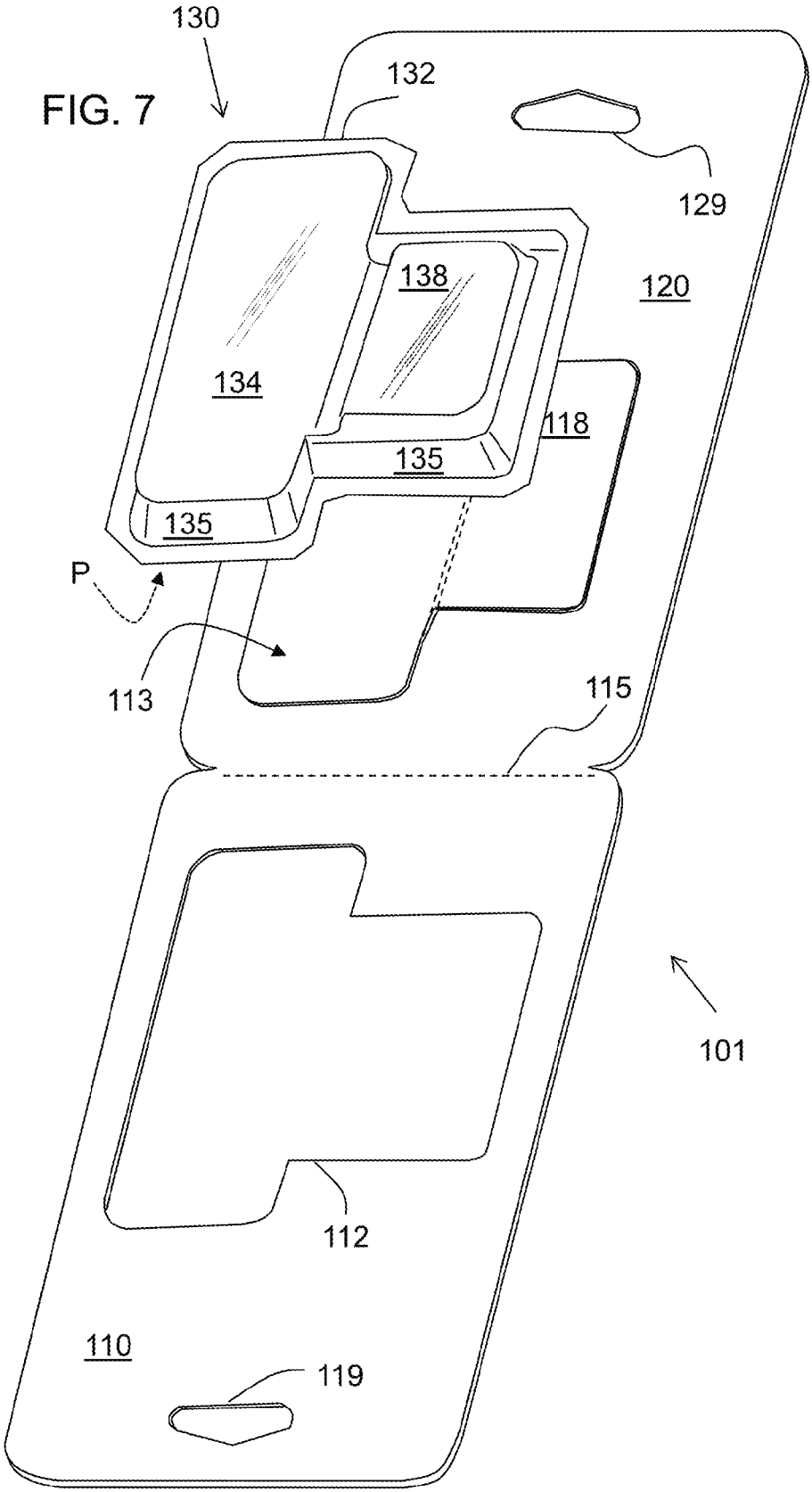
FIG. 7 shows a perspective view from the end of the package with a blister attached.
Figure 8:
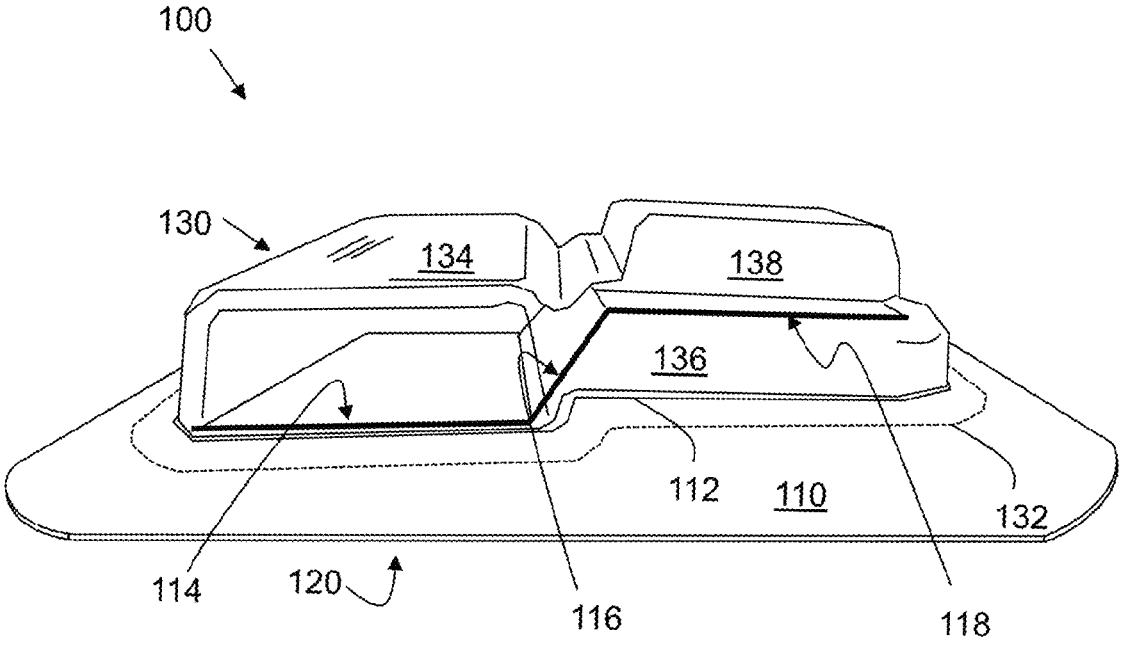
FIG. 8 shows a perspective view of the blister card.

FIG. 7 shows a blister 130 positioned above the cutaway portion 113. The blister 130 may include a peripheral blister flange 132, one or more side walls 135, and one or more volumes such as a first blister volume 134 and a second blister volume 138. Blister 130 may contain a product P. When blister 130 has been positioned upon back panel 120, the front panel 110 may be folded over upon the blister 130 and back panel 120 as shown in FIG. 8 with the blister flange 132 sandwiched between the panels. Alternately, the blister 130 may be inverted from the orientation seen in FIG. 7 and positioned into the window 112 in front panel 110. The product P may be placed into the blister volume or volumes, and the back panel 120 folded onto the front panel 110.

FIG. 8 shows a perspective view of the blister card 100. The front panel 110 and back panel 120 may be sealed together, for example by heat sealing, trapping the blister flange 132 between the panels. The cutaway lower portion 114 may rest on and may be attached to the back panel 120, forming a first floor of a first blister volume 134, which the divider portion 118 may be raised (through riser portion 116) to become a second floor or divider of the second blister volume 138. The riser portion 116 and cutaway divider portion 118 thus may divide the blister 130 into three volumes, for example first blister volume 134, as well as an upper blister volume 138 and a lower blister volume 136. Depending on the design of the cutaway portion 113 and blister 130, the blister 130 may be divided into two, three, or more volumes.

For example, and as shown in FIG. 8, riser portion 116 may divide blister 130 or a part of the blister 130 laterally or horizontally (from the viewpoint as shown in FIG. 8) into first blister volume 134 and lower blister volume 136, as if riser portion 116 were a wall dividing rooms on the same level of a house. The riser portion 116 may extend generally all the way across the blister 130, or partially across similar to a wall in a house. The divider portion 118 may divide blister 130 vertically (from the viewpoint as shown in FIG. 8) into lower blister volume 136 and upper blister volume 138, as if divider portion 118 were a floor of a house dividing an upper level and a lower level. The divider portion 118 may extend generally all the way across blister 130, or partially across similar to a balcony or mezzanine in a house.

At least part of lower portion 114 may be in contact with the back panel 120. The lower portion 114 may be attached to the back panel, as previously described. The riser portion 116 may extend generally away from the back panel 120, for example upward at any desired angle with respect to back panel 120. The divider portion 118, or at least a part thereof, may be spaced away from back panel 120. The divider portion 118 may be generally parallel to back panel 120, or may be at an angle to the back panel 120, depending on manufacturing preference. All three portions 114, 116, 118 may have generally flat or planar surfaces as shown, or may have curved surfaces. All three portions likewise may have generally straight edges as shown, or may have curved edges, or both straight and curved edges.

Although the blanks may be typically be provided as single pieces, as shown, they may also be provided as multiple pieces. The blanks may be made of a sheet material such as paperboard, or of a tear-resistant paperboard such as MeadWestvaco NATRALOCK®.

Blister 130 may be made with common thermoform plastics such as PVC or APET but may also include a recycled material such as RPET or a biodegradable material such as PLA. However other materials including other plastics or paperboard may also be used. Besides thermoforming, the case or blister may be formed by injection molding or other manufacturing methods.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

Portions of the blister cards may be made of one, two, or more layers of material. It is to be understood that additional layers of material may be used based on manufacturing preferences. Portions of certain panels may be folded over or around the portions of other panels, creating multiple layers of material.

The invention claimed is:

1. A blister card comprising:

a front panel with a window therein created by at least partly separating a cutaway portion from the front panel;

a back panel attached to the front panel;

a blister comprising a blister cavity and a peripheral flange, the blister cavity protruding through the window and the peripheral flange received between the front and back panels;

wherein the cutaway portion is positioned between the blister and the back panel; and wherein the cutaway portion divides the blister cavity into two or more volumes.

2. The blister card of claim 1, wherein the cutaway portion is in register with the window.

3. The blister card of claim 1, wherein the cutaway portion comprises one or more fold lines.

4. The blister card of claim 1, wherein the cutaway portion comprises a lower portion connected by a first fold line to a riser portion.

5. The blister card of claim 4, wherein the riser portion is connected by a second fold line to a divider portion.

6. The blister card of claim 5, wherein the lower portion is in contact with the back panel, the riser portion extends generally away from the back panel, and the divider portion is spaced apart from the back panel.

7. The blister card of claim 6, wherein the riser portion is at an angle to the back panel, and the divider portion is substantially parallel to the back portion.

8. The blister card of claim 6, wherein the lower portion is attached to the back card.

9. The blister card of claim 1, wherein the front panel and back panel are fastened together by adhesive.

10. The blister card of claim 1, wherein the front panel and back panel are fastened together by heat sealing.

11. A method of constructing a blister card, the method comprising:

providing a front panel with a window therein created by at least partly separating a cutaway portion from the front panel;

providing a back panel;

folding the cutaway portion into three parts including a lower portion foldably connected to a riser portion, in turn foldably connected to a divider portion;

placing the lower portion onto the back panel;

providing a blister comprising a blister cavity and a peripheral flange;

positioning the blister upon the back panel with the cutaway portion received in the blister cavity;

placing the front panel upon the blister and back panel so that the blister cavity protrudes through the window and the peripheral flange is received between the front and back panels; and attaching the front panel to the back panel;

wherein the cutaway portion divides the blister cavity into two or more volumes.

12. The method of claim 11, further comprising the step of placing a product item or items within at least one of the volumes.

* * * * *